US005800971A

United States Patent [19]

Zengerle et al.

[11] Patent Number: 5,800,971

[45] Date of Patent: Sep. 1, 1998

[54] PHOTOGRAPHIC ELEMENT CONTAINING CODISPERSIONS OF YELLOW METHINE FILTER OR DENSITY CORRECTION DYES AND REDUCING AGENTS

[75] Inventors: Paul Leo Zengerle, Rochester; Paul Barrett Merkel, Victor, both of N.Y.

[73] Assignee: Eastman Kodak Company, Rochester, N.Y.

[21] Appl. No.: 583,394

[22] Filed: Jan. 5, 1996

[51] Int. Cl.[6] ..... G03C 1/46

[52] U.S. Cl. ..... 430/504; 430/507; 430/517; 430/522; 430/559; 430/551

[58] Field of Search ..... 430/504, 517, 430/522, 559, 551, 507

[56] References Cited

U.S. PATENT DOCUMENTS

| | | | |
|---|---|---|---|
| 4,316,013 | 2/1982 | Hunt | 542/445 |
| 4,764,455 | 8/1988 | Arakawa et al. | 430/533 |
| 4,840,884 | 6/1989 | Mooberry et al. | 430/557 |
| 5,079,134 | 1/1992 | Toya | 430/522 |
| 5,098,818 | 3/1992 | Ito et al. | 430/522 |
| 5,106,942 | 4/1992 | Krutaki et al. | 528/272 |
| 5,213,956 | 5/1993 | Diehl et al. | 430/522 |
| 5,260,179 | 11/1993 | Diehl et al. | 430/517 |
| 5,354,650 | 10/1994 | Southby et al. | 430/955 |
| 5,380,634 | 1/1995 | Kiekens et al. | 430/517 |
| 5,447,819 | 9/1995 | Mooberry et al. | 430/955 |
| 5,455,140 | 10/1995 | Texter et al. | 430/546 |
| 5,455,141 | 10/1995 | Owaczarczyk et al. | 430/359 |
| 5,457,004 | 10/1995 | Mooberry et al. | 430/359 |
| 5,470,688 | 11/1995 | Texter et al. | 430/559 |

FOREIGN PATENT DOCUMENTS

| | | |
|---|---|---|
| 04-40429 | 2/1992 | Japan . |
| 92/21064 | 11/1992 | WIPO . |

*Primary Examiner*—Geraldine Letscher
*Attorney, Agent, or Firm*—Arthur E. Kluegel

[57] ABSTRACT

The invention provides a multilayer color negative photographic element comprising a support, at least one light-sensitive silver halide emulsion layer sensitive to each of the blue, green and red regions of the visible spectrum, one or more yellow or orange-yellow cyano benzoxazolyl or cyano benzothiazolyl arylidene type methine filter or density correction dyes of structure I, below, codispersed with one or more hydroquinone, catechol or sulfonamidophenol reducing agents,

I wherein:

$R_1$ is hydrogen or an alkyl group;

$R_2$ is an alkyl group or an aryl group;

$R_3$ is hydrogen, a halogen, an alkyl group, an alkoxy group or an aryloxy group;

$R_4$ is hydrogen or an alkyl group;

$R_5$ is hydrogen or an alkyl group;

$R_6$ is hydrogen or an alkyl group;

X is oxygen or sulfur;

each $R_7$ is independently selected from the group consisting of a halogen, an alkyl, aryl, alkoxy, aryloxy, carbonamido, sulfonamido, carbamoyl, alkoxycarbonyl, aryloxycarbonyl, acyloxy, acyl, sulfamoyl, sulfonyl, sulfoxyl, sulfonyloxy, alkylthio, arylthio, and cyano groups;

n is 0, 1, 2 or 3; and provided that $R_1$ and $R_2$ or $R_2$ and $R_3$ may join to form a ring.

The photographic element of the invention exhibits improved hue due to the presence of the dye codispersion of the invention.

26 Claims, No Drawings

PHOTOGRAPHIC ELEMENT CONTAINING CODISPERSIONS OF YELLOW METHINE FILTER OR DENSITY CORRECTION DYES AND REDUCING AGENTS

CROSS-REFERENCE TO RELATED APPLICATION

This application is a continuation of Provisional Application Ser. No. 60/006,980 filed Oct. 31, 1995, now abandoned.

FIELD OF THE INVENTION

This invention relates to color negative photographic elements comprising codispersions of yellow filtration or density correction dyes and reducing agents.

BACKGROUND OF THE INVENTION

Modern color negative films usually contain dyes coated in one or more layers for a variety of purposes. In addition to being utilized for spectral sensitization, dyes may be used for filtration of specific wavelengths of exposing light (either as intergrain absorbers or in separate layers containing no silver halide), for antihalation, and to adjust the background density (Dmin) of color negative films for printing purposes. Dyes that are used to adjust Dmin of color negative films to produce prints of proper color balance may be referred to as density correction dyes. However, such dyes may also be used for filtration and/or antihalation purposes in addition to being used to adjust color balance.

Yellow and orange dyes that have been used in color negative films for antihalation and for Dmin adjustment have suffered from a number of deficiencies including poor dispersibility, improper hue and instability on long term storage or on storage at elevated temperatures. Losses in blue density due to dye instability can result in improper color balance when prints are made from negatives that have been stored for appreciable times either before or after development. Some yellow dyes that are stable by themselves become unstable when coated in the same layer as other components, such as reducing agents that serve as scavengers for oxidized developer. Thus, there is a need for yellow dye formulations that have the proper hue, good dispersibility and that show good stability even in the presence of other chemicals typically incorporated into color negative films.

International Patent Application WO 92/21064 A1 (EP 540,729 A1) of Mooberry et al discloses photographic elements comprising blocked filter dyes that are designed to unblock and wash out on processing. Among the many blocked dyes disclosed is a blocked cyano benzoxazolyl arylidene dye (16). Unlike the yellow methine dyes of the present invention, which are designed to be permanent, the blocked dyes of Mooberry are removed on processing. Furthermore, Mooberry does not does not disclose codispersions of the yellow methine dyes and reducing agents of this invention.

U.S. Pat. No. 4,840,884 of Mooberry et al. discloses blocked cyano benzoxazolyl arylidene type methine dyes (Example 4). However, the arylidene nitrogen atom of these dyes is substituted with a group that is outside the scope of the substituents ($R_1$ or alternatively $R_2$, below) of this invention. Furthermore, these blocked dyes are not designed to be used in a filter layer or in an antihalation layer, nor are they codispersed with reducing agents.

Japanese Kokai JP04-040429 discloses yellow methine dyes in nonlinear optical recording materials. This disclosure does not pertain to photographic materials or to use of such dyes for filtration or density correction alone or codispersed with reducing agents.

U.S. Pat. No. 5,106,942 (WO 91/07915) of Krutak et al. discloses cyano benxoxazolyl and cyano benzothiazolyl arylidene type methine dyes attached to polymers, but offers no teaching of the use of such dyes in photographic elements or for filtration or density correction either alone or codispersed with reducing agents.

U.S. Pat. No. 4,316,013(GB 2,077,282) of Hunt discloses cyano benzoxazolyl and cyano benzothiazolyl arylidene type methine dyes for dyeing of synthetic fibers. However, this reference does not teach the use of such dyes in photographic elements or for filtration or density correction either alone or in codispersions with incorporated reducing agents.

A problem to be solved is to provide a photographic element containing a yellow or orange dye which exhibits improved hue as coated.

SUMMARY OF THE INVENTION

The invention provides a multilayer color negative photographic element comprising a support, at least one light-sensitive silver halide emulsion layer sensitive to each of the blue, green and red regions of the visible spectrum, one or more yellow or orange-yellow cyano benzoxazolyl or cyano benzothiazolyl arylidene type methine filter or density correction dyes of structure I, below, codispersed with one or more hydroquinone, catechol or sulfonamidophenol reducing agents,

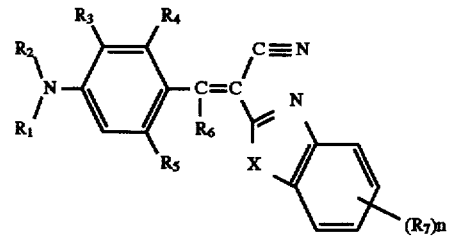

I wherein:

$R_1$ is hydrogen or an alkyl group;

$R_2$ is an alkyl group or an aryl group;

$R_3$ is hydrogen, a halogen, an alkyl group, an alkoxy group or an aryloxy group;

$R_4$ is hydrogen or an alkyl group;

$R_5$ is hydrogen or an alkyl group;

$R_6$ is hydrogen or an alkyl group;

X is oxygen or sulfur;

each $R_7$ is independently selected from the group consisting of a halogen, an alkyl, aryl, alkoxy, aryloxy, carbonamido, sulfonamido, carbamoyl, alkoxycarbonyl, aryloxycarbonyl, acyloxy, acyl, sulfamoyl, sulfonyl, sulfoxyl, sulfonyloxy, alkylthio, arylthio, and cyano groups;

n is 0, 1, 2 or 3; and provided that $R_1$ and $R_2$ or $R_2$ and $R_3$ may join to form a ring.

The photographic element of the invention exhibits improved hue due to the presence of the dye codispersion of the invention.

DETAILED DESCRIPTION OF THE INVENTION

This invention relates to color negative photographic materials or elements comprising one or more yellow methine filter dyes or density correction dyes having the generic structure shown in the Summary of the Invention codispersed (i.e. dissolved in the same oil phase) with one or more reducing agents of the generic structure as shown. The yellow methine dyes of this invention are suitably coated in a filter layer between blue and green sensitive layers or in an antihalation layer. When used in a filter layer the yellow methine dyes of this invention may replace some or all of either the bleachable yellow dye(s) or the Carey-Lea silver normally used for light filtration.

The invention provides color negative elements comprising density correction dye formulations of the proper hue that produce prints of proper color balance. Further, it provides dispersions of density correction or filter dyes that are stable toward crystallization upon melt hold or upon cold storage.

The hydroquinone, catechol and sulfonamidophenol reducing agents that are codispersed in the same oil phase with the yellow methine dyes of structure I are preferably of structures II, III and IV, respectively,

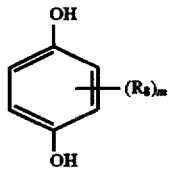

II

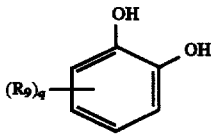

III

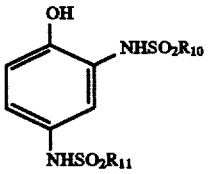

IV wherein:

each $R_8$ is an independently selected from the group consisting of an alkyl group, a carbonamido group, a carbamoyl group, an alkoxy group, an aryloxy group and a chlorine atom, and m is 1 to 4;

each $R_9$ is independently selected from the group consisting of an alkyl group, a carbonamido group, a carbamoyl group an alkoxy group, an aryloxy group and a chlorine atom, and q is 1 to 4;

$R_{10}$ is an aryl group or an alkyl group; and $R_{11}$ is an aryl group or an alkyl group.

In one embodiment of this invention $R_1$ is hydrogen. In another embodiment of this invention $R_2$ is an alkyl group. In another embodiment of this invention n is 0, 1 or 2. In a further embodiment of this invention $R_4$ is hydrogen. In another embodiment of this invention X is oxygen. In still another embodiment of this invention $R_5$ is an alkyl group. In another embodiment of this invention $R_3$ is an alkoxy group. In another embodiment of this invention $R_6$ is hydrogen. In a particularly suitable embodiment of this invention $R_1$ is hydrogen, $R_2$ is alkyl, $R_3$ is hydrogen or alkyl, $R_4$ is hydrogen, $R_5$ is alkyl, $R_6$ is hydrogen, X is oxygen, n is 0 or 1, and $R_7$ is an alkyl group, a sulfonamido group or a halogen atom, such as chlorine, in the para position relative to the oxygen of the benzofuran ring. In another particularly suitable embodiment of this invention $R_1$ and $R_2$ are alkyl groups, $R_3$, $R_4$ and $R_6$ are hydrogen, $R_5$ is an alkyl group, n is 0 or 1 and $R_7$ is an alkyl group, a sulfonamido group or a halogen in the para position relative to X, which is oxygen.

In another embodiment of this invention the reducing agent is of structure II, m is 2 and the $R_8$ groups are alkyl groups in the 2- and 5-positions of the benzene ring.

The color negative elements of this invention may be color print films used for making color prints on color photographic paper or they may be motion picture color negative films.

Useful absorption maxima for the yellow methine dyes of this invention depend upon the spectral band shapes and the primary intended use (filtration or density correction) but are in the range of 435–480 nm as coated in the photographic materials of this invention. Useful coated levels of the yellow methine dyes of this invention also depend upon molecular weight and extinction coefficient, but typically range from 0.005 to 0.15 g/sq m, with levels of 0.010 to 0.10 g/sq m being preferred. Useful weight ratios of yellow methine dye to reducing agent in the codispersions of this invention range from about 1:0.2 to 1:5, with 1:0.5 to 1:2 being desirable.

The alkyl substituents comprising $R_1$ through $R_{11}$ may unbranched, branched or cyclic and may be unsubstituted or substituted. The alkoxy groups comprising $R_3$, $R_7$, $R_8$ or $R_9$ may be branched or unbranched and substituted or unsubstituted. The aryl groups comprising $R_2$, $R_7$, $R_{10}$ and $R_{11}$ and the aryloxy groups comprising $R_3$, $R_4$, $R_8$ and $R_9$ may be unsubstituted or substituted. The carbonamido and carbamoyl groups comprising $R_8$ and $R_9$ may also be unsubstituted or substituted. The carbonamido, sulfonamido, carbamoyl, acyloxy, acyl, alkoxycarbonyl, aryloxycarbonyl, sulfamoyl, sulfonyl, sulfoxyl, sulfonyloxy, alkylthio and arylthio groups comprising $R_7$ may also be further substituted. Any substituent may be chosen for the alkyl, aryl, alkoxy, aryloxy, $R_7$ $R_8$ and $R_9$ groups that does not adversely affect the performance of the yellow methine dye formulations of this invention. Suitable substituents include halogen atoms, such as chlorine, alkenyl groups, alkynyl groups, aryl groups, hydroxy groups, alkoxy groups, aryloxy groups, acyl groups, acyloxy groups, alkoxycarbonyl groups, aryloxycarbonyl groups, carbonamido groups (including alkyl-, aryl-, alkoxy-, aryloxy- and alkylamino-carbonamido groups), carbamoyl groups, carbamoyloxy groups, sulfonamido groups, sulfamoyl groups, alkylthio groups, arylthio groups, sulfoxyl groups, sulfonyl groups, sulfonyloxy groups, alkoxysulfonyl groups, aryloxysulfonyl groups, trifluoromethyl groups, cyano groups, imido groups and heterocyclic groups, such as 2-furyl, 3-furyl, 2-thienyl, 1-pyrrolyl, 2-pyrrolyl, 1-imidazolyl and N-succinimidyl groups. The aryl groups comprising $R_2$, $R_7$, $R_{10}$ and $R_{11}$ and the aryloxy groups comprising $R_7$, $R_8$ and $R_9$ may also be substituted with one or more unbranched, branched or cyclic alkyl groups.

It is also desirable that the yellow methine dyes of this invention have low water solubility and remain in the layer(s) in which they are coated during coating, storage and processing. To help ensure this, the total number of carbon atoms in $R_1$ through $R_7$ taken together is at least 8, and preferably at least 10. In addition, to minimize diffusion and washout, it is preferred that the yellow methine dyes of this invention do not contain charged groups, such as quaternary ammonium groups, or easily ionizable carboxyl or sulfonate groups. It is also desirable that the total number of carbon atoms in the $R_8$ groups, or the $R_9$ groups or the combined $R_{10}$ and $R_{11}$ groups of the reducing agents of this invention be at least 12 and typically 16 or more to minimize wandering.

The yellow methine dye plus reducing agent codispersions of this invention are incorporated in the color negative films of this invention by first dispersing an oil phase containing dye and reducing agent in an aqueous phase containing a binder, such as gelatin, and one or more surfactants. The dye-containing dispersion is then coated in the appropriate layer of a multilayer film on a suitable support. The oil phase usually consists of the dye plus reducing agent dissolved in one or more high-boiling solvents. This is typically added to an aqueous solution of gelatin and surfactant, which is followed by milling or homogenization of the mixture to disperse the oil phase in the aqueous phase as small particles. Removable (by washing, evaporation or dialysis) auxiliary solvents such as ethyl acetate, cyclohexanone or 2,2-butoxyethoxyethyl acetate may also be used in the preparation of such dispersions to facilitate dissolution of the dye in the oil phase. However, some codispersions of the yellow methine dyes and the reducing agents of this invention do not require the use of a removable auxiliary solvent for dispersion preparation.

Hues of the yellow dye formulations of this invention can be shifted to optimize the spectral properties by choice of high-boiling solvent. High-boiling solvents useful for the practice of this invention include aryl phosphates (e.g. tricresyl phosphate), alkyl phosphates (e.g. trioctyl phosphate), mixed aryl alkyl phosphates (e.g. diphenyl 2-ethylhexyl phosphate), aryl, alkyl or mixed aryl-alkyl phosphonates, phosphine oxides (e.g. trioctylphosphine oxide), esters of aromatic acids (e.g. dibutyl phthalate), esters of aliphatic acids (e.g. dibutyl sebacate), alcohols (e.g. 2-hexyl-1-decanol), phenols (e.g. p-dodecylphenol), carbonamides (e.g. N,N-dibutyldodecanamide or N-butylacetanalide), sulfoxides (e.g. bis(2-ethylhexyl) sulfoxide), sulfonamides (e.g. N,N-dibutyl-p-toluenesulfonamide) or hydrocarbons (e.g. dodecylbenzene). Additional high-boiling solvents and auxiliary solvents are noted in *Research Disclosure*, December 1989, Item 308119, p 993. Useful dye:high-boiling solvent weight ratios range from about 1:0.1 to 1:10, with 1:0.2 to 1:5.0 being preferred. The yellow dyes of this invention may also be codispersed with the reducing agents of this invention without the use of a permanent high-boiling solvent.

The yellow dye dispersions of this invention may be coated in the color negative photographic materials of this invention either alone in one or more layers or together with other dyes or addenda in the same layers or layer. The yellow dyes of this invention can be coated in any layer on either side of the support. In one preferred embodiment of this invention the yellow density correction dyes are coated in an antihalation layer under (i.e. furthest from the direction of exposure) the light-sensitive silver halide layers. The antihalation layer is often adjacent to the transparent support. The yellow dyes of this invention may also be coated between the green-sensitive and red-sensitive layers of the color negative films of this invention. In another preferred embodiment, the yellow dyes of this invention are coated in a filtration layer under the blue-sensitive layer(s) and over the green sensitive layer(s) of the color negative film. This reduces unwanted blue exposure of the green-sensitive layers and can allow removal of some or all of normally used filtration materials, such as bleachable yellow dyes or Carey-Lea Silver. The yellow dyes of this invention may also be coated above the blue sensitive layer(s) of the color negative films for adjustment of blue speed. The yellow dyes of this invention may also be coated in an emulsion-containing layer such as the least-sensitive magenta dye forming layer.

In particularly useful embodiments of this invention the yellow methine dyes of this invention are coated in either a filtration layer between the blue and green-sensitive layers or in an antilahation layer, usually adjacent to the support.

Examples of nondiffusible yellow methine dyes of this invention include, but are not limited to, the following (D1–D35):

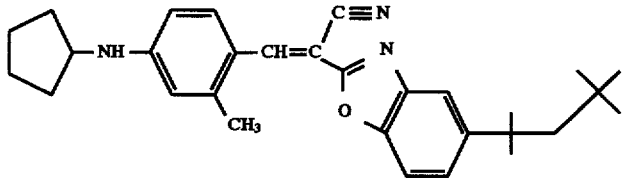

D1

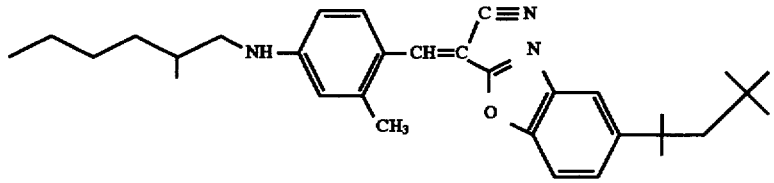

D2

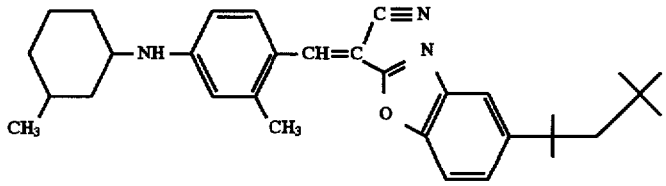

D3

-continued
D4
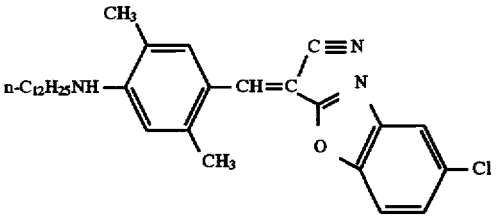
D5
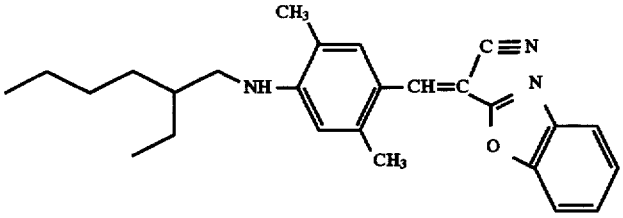
D6
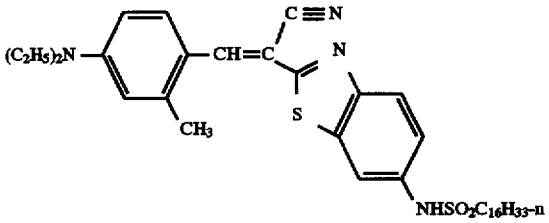
D7
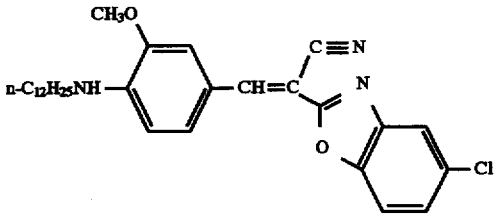
D8
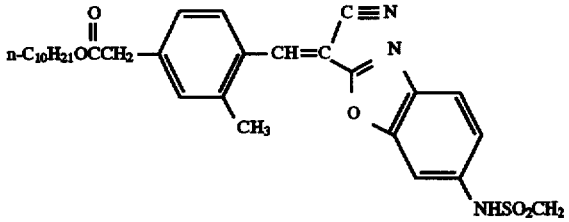
D9
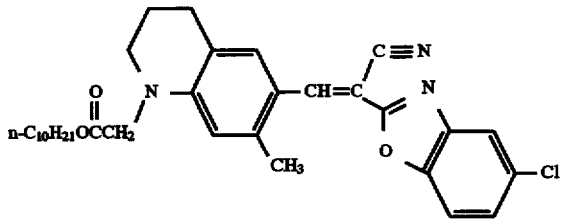
10
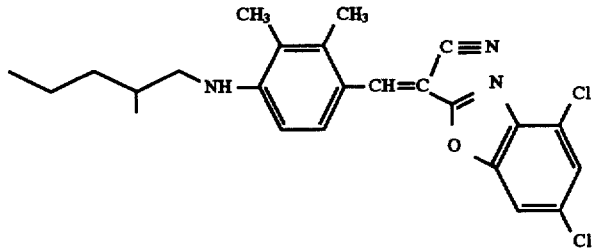

-continued
D11
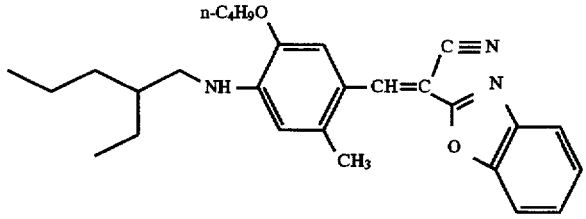
D12
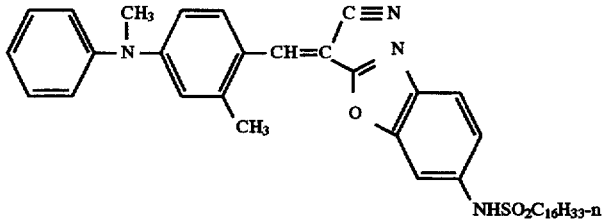
D13
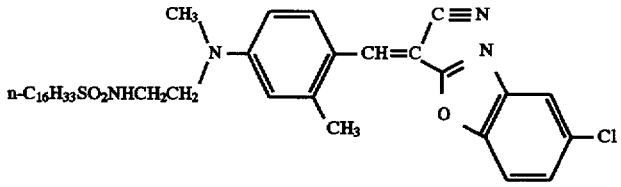
D14
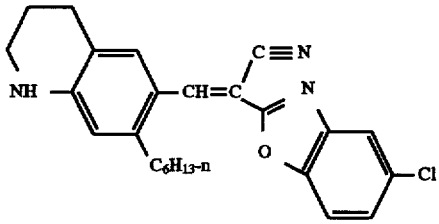
D15
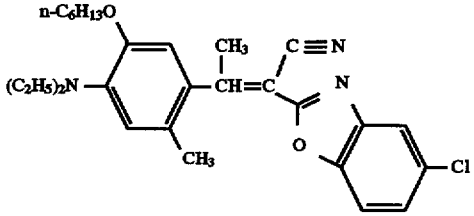
D16
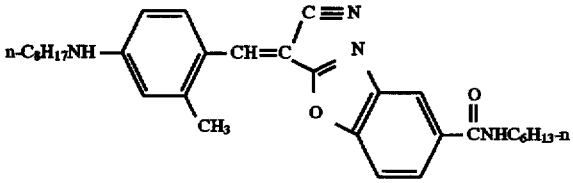
D17
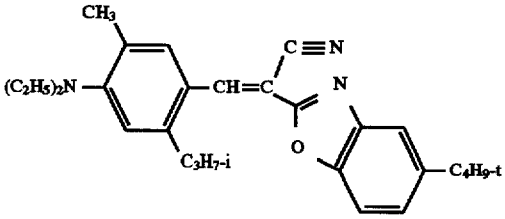

-continued
D18
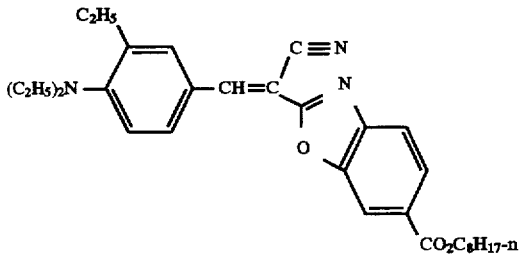
D19
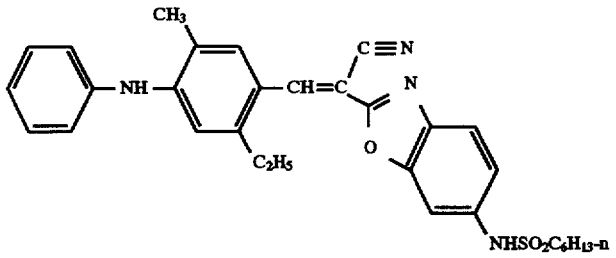
D20
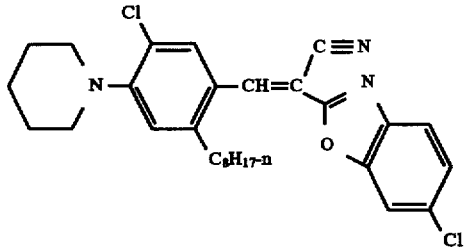
D21
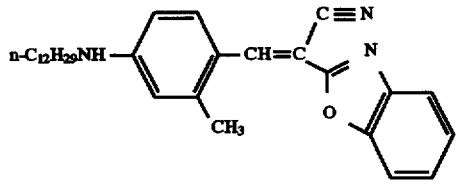
D22
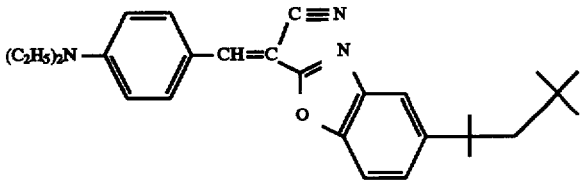
D23
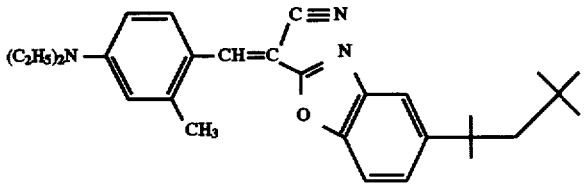
D24
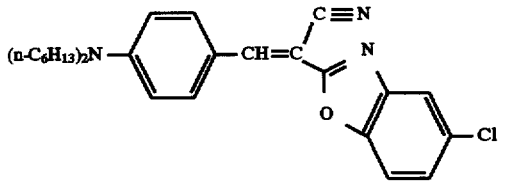

-continued
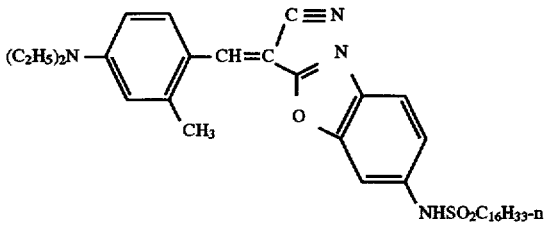
D25
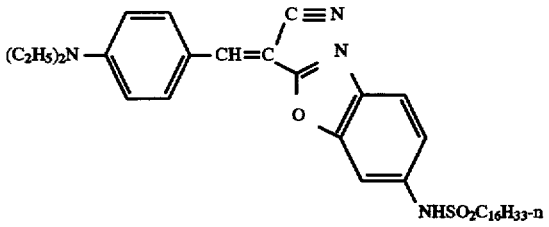
D26
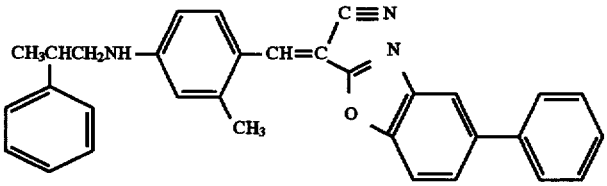
D27
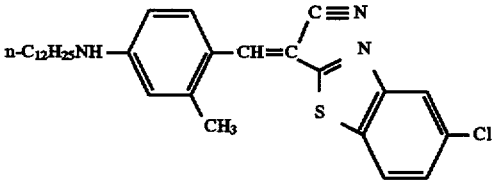
D28
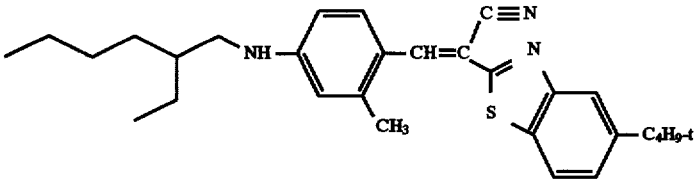
D29
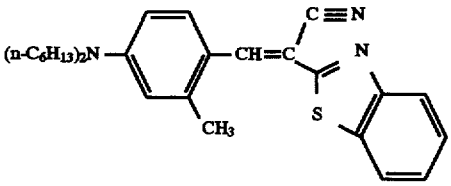
D30
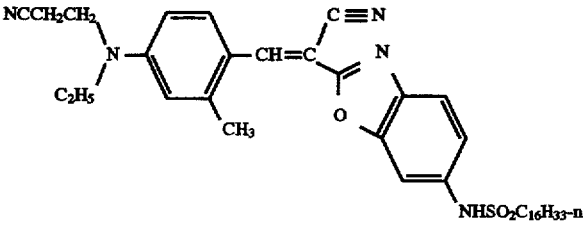
D31

-continued
D32
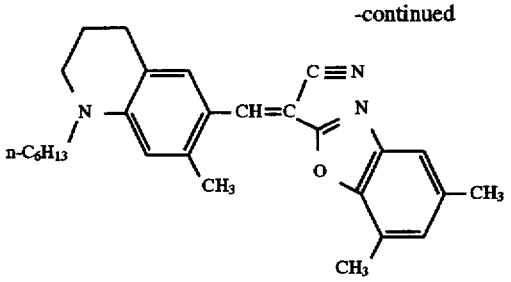
D33
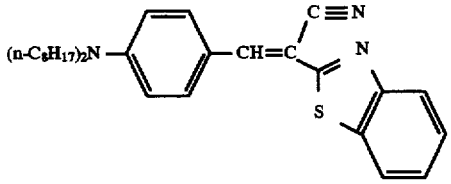
D34
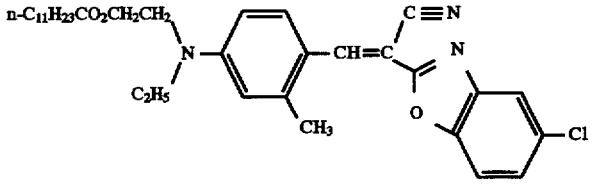
D35
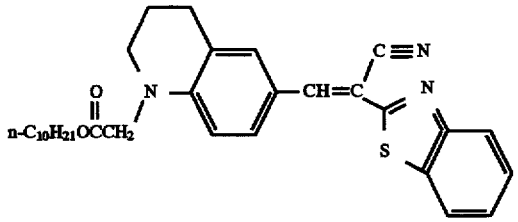
Examples of nondiffusible reducing agents (II, III and IV) of this invention include, but are not limited to, the following (R1–R12):
R1
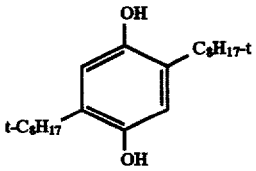
R2
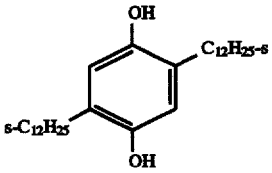
R3
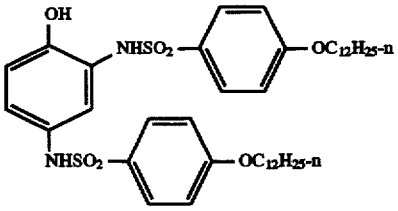
-continued
R4
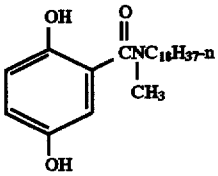
R5
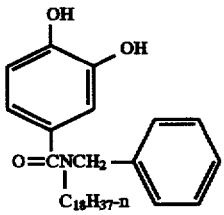
R6
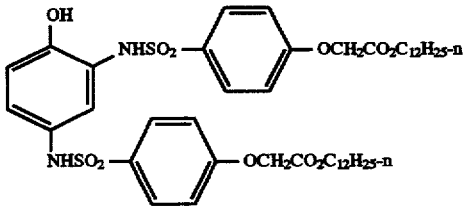

-continued

R7

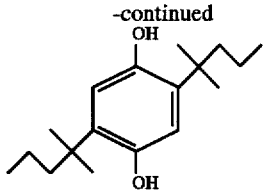

R8

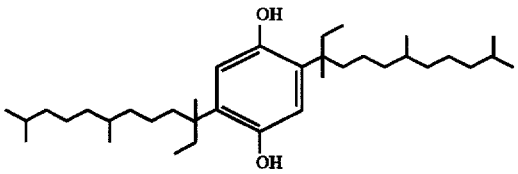

R9

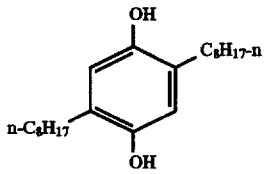

R10

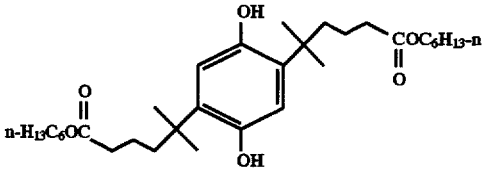

R11

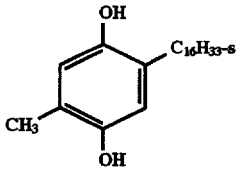

R12

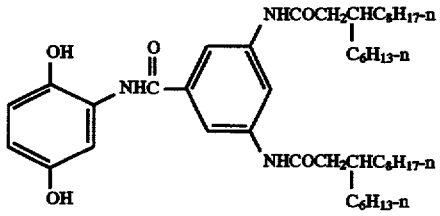

The invention has further advantages in that it provides color negatives that after long term storage continue to provide prints of the proper color balance due to use of methine dye formulations having improved thermal stability. As a further advantage, the invention provides color negative films in which some or all the conventional yellow dye(s) or Carey-Lea silver used for filtration of blue light is replaced by one or more permanent yellow filter dyes. Additionally, it provides color negative films comprising yellow methine dyes that are used both for filtration of blue light during exposure and for density correction to provide proper color balance in printing. The provided yellow methine dyes may be used both for density correction and antihalation. Thinner color negative films are made possible by using a single yellow dye for both filtration of blue light and density correction and reduced chemical laydown can be achieved by the use of high covering power density correction dyes of the proper hue. The dye of the invention is readily dispersed. Another advantage of this invention is to provide density correction for printing of color negative films comprising magnetic recording layers.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element.

Multicolor elements contain image dye-forming units sensitive to each of the three primary regions of the spectrum. Each unit can comprise multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Pat. No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. No. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

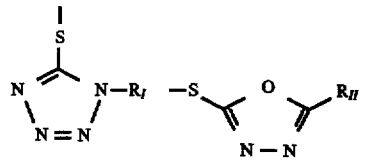

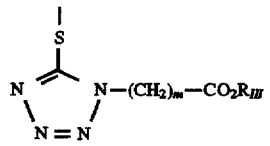

-continued

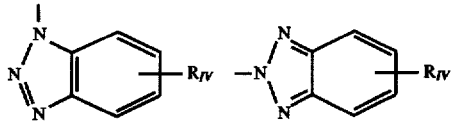

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

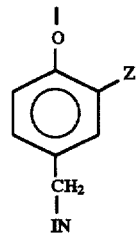

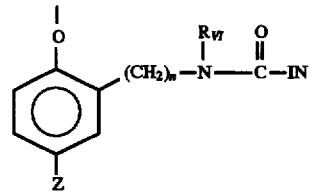

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

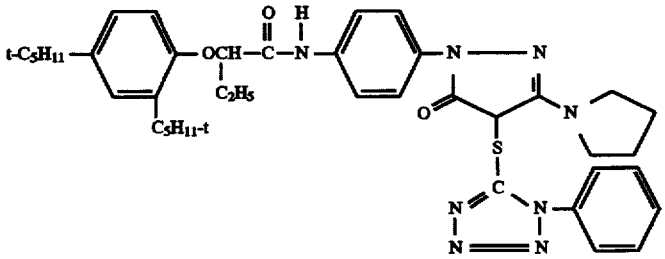

D2

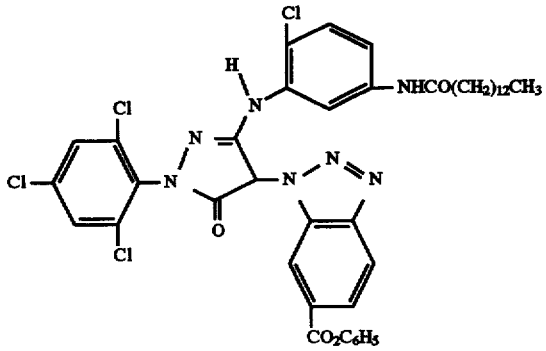

-continued
D3
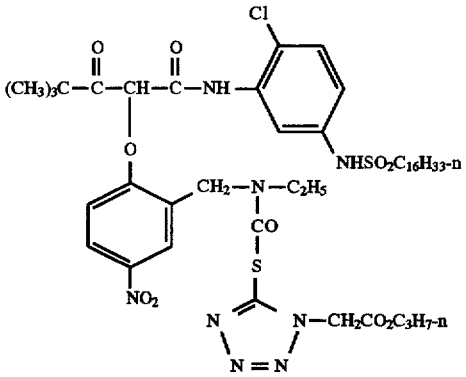
D4
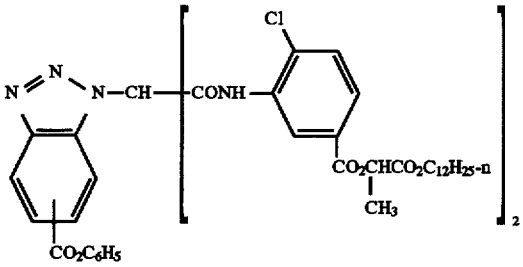
D5
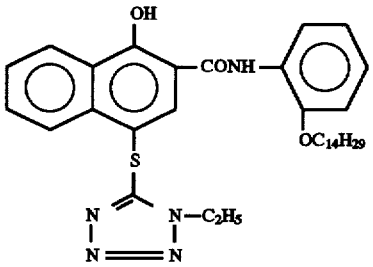
D6
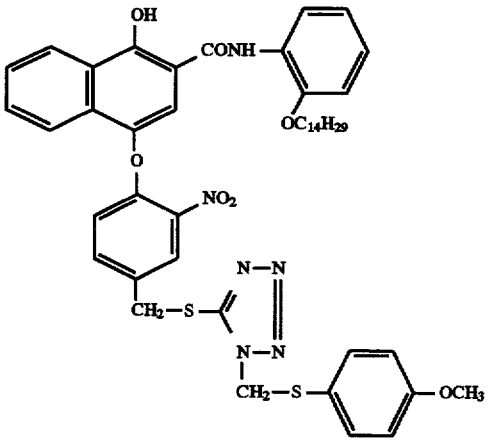

-continued
D7
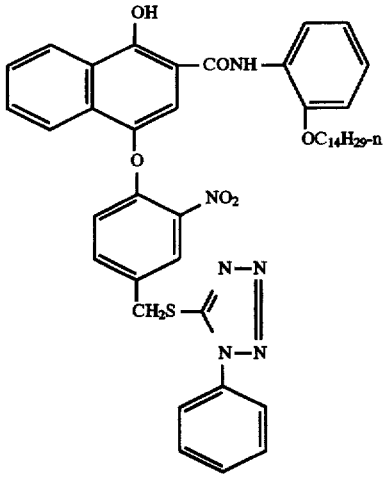
D8
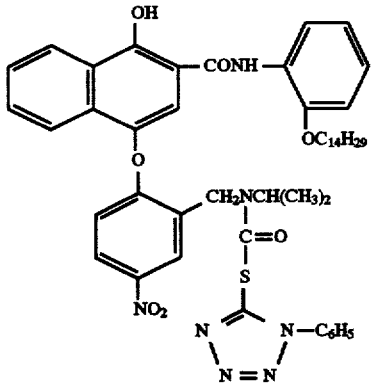
D9
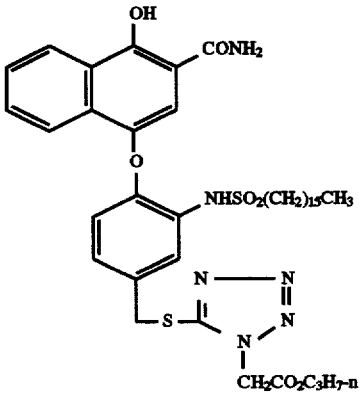

-continued

D10

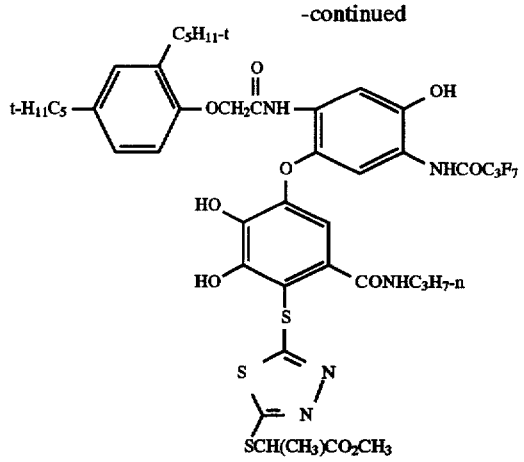

D-11

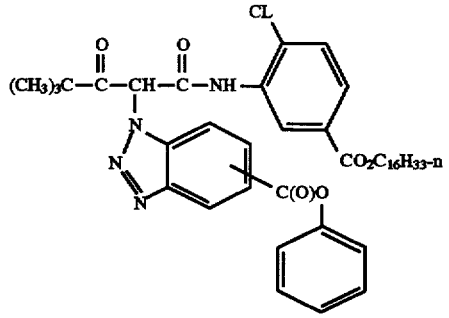

D-12

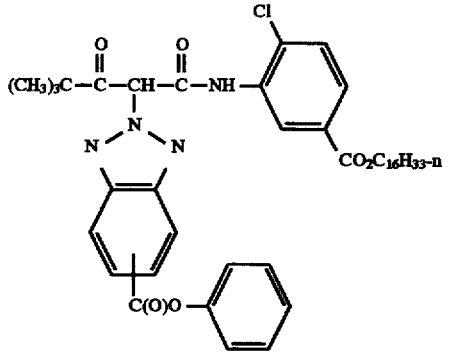

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Such negative working emulsions are typically sold with instructions to process using a color negative method such as the mentioned C-41 process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the various copending applications as well as patents and other publications cited in this specification are incorporated herein by reference.

The usefulness and advantages of the color negative materials of this invention comprising the yellow dye plus reducing agent codispersions of this invention are illustrated by the following Examples, which show the desirable dispersion stability properties and hue properties of the codispersions of this invention and the use of such codispersions in a multilayer color negative film of this invention.

EXAMPLE 1

Preparation and Properties of Codispersions of Yellow Dye D23 and Reducing Agent $R_1$ of This Invention To prepare dispersions of yellow dye D23, 4.0 g of D23 was dissolved in 8.0 g of tri-cresylphosphate (S-1) and 12.0 g of ethyl acetate at 75° C. This oil phase was then combined with an aqueous phase solution consisting of 8.0 g of gelatin, 6.0 g of a 10% solution of Alkanol-XC (Dupont), and 62.0 g of distilled water. This mixture was then passed through a Gaulin colloid mill five times followed by removal of ethyl acetate by rotary evaporation. Distilled water was then added back to replace the ethyl acetate to form Dispersion A which consisted of 4.0% dye and 8.0% gelatin. Dispersion B was prepared similarly except that 2.0 of 2,5-di-octylhydroquinone (R1) was also dissolved in the oil phase and 60.0 g of distilled water was used in the aqueous phase. Dispersion C was similarly prepared using 4.0 g of R1 in the oil phase and 58.0 g of distilled water in the aqueous phase. Dispersion D was also similarly prepared using 8.0 g of R1 in the oil phase and 54.0 g of distilled water in the aqueous phase. These dispersions were held for 96 hours at 45° C. and then examined for dye crystallization using polarized-light microscopy. Results are summarized below in Table I

TABLE I

| Dispersion | Microscopic Appearance (96 h/45° C.) |
|---|---|
| A (Comparison) | Severe crystallization, many long needles |
| B (Invention) | Some crystallization, several small needles |
| C (Invention) | Very few small needle-shaped crystals |
| D (Invention) | Some crystallization, several small plates |

These results clearly show that the presence of R1 in the oil phase substantially reduces the propensity for dye crystallization in the codispersions (B-D) of this invention. This allows such dispersions to be coated in multilayer color negative films using normal melt hold times (of about 4 hours) with little or no crystallization.

Coatings of these dispersions on cellulose triacetate were prepared in which the D23 laydown was sufficient (about 0.12 g/sq m) to yield an optical density at the absorption maximum of about 1.1. The absorption spectra of the films were measured using a Perkin Elmer Lambda 2S spectrophotometer. Spectral results are summarized in Table II, below.

TABLE II

| Dispersion | Density @ 420 nm | Lambda-max |
|---|---|---|
| A | 0.69 | 462 nm |
| B | 0.65 | 462 nm |
| C | 0.61 | 466 nm |
| D | 0.50 | 470 nm |

These data clearly indicate that the presence of R1 in the oil phase with dye D23 results in lower densities in the short blue wavelength region of the spectrum and a bathochromic hue shift. Both of these features are desirable for density correction in many color negative films, especially in films comprising magnetic recording layers.

EXAMPLE 2

Additional Dye/Reducing Agent Codispersions of This Invention

Dispersions E, F, and G were prepared as Dispersions A, C, and D, respectively, except that tri-cresylphosphate was replaced with tri-(2-ethylhexyl)phosphate (S-6). These dispersions were held for four hours at 45° C. and then examined for dye crystallization. Results are summarized below in Table III.

TABLE III

| Dispersion | Microscopic Appearance (4 h/45° C.) |
|---|---|
| E (Comparison) | Severe crystallization, many small needles |
| F (Invention) | Some small needle-shaped crystals |
| G (Invention) | Few small plate-like crystals |

These results also indicate that improved dispersion stability is obtained by codispersing RI in the oil phase with dye D23.

These dispersions were also coated and their spectral properties were determined as described in Example 1. The results are given below in Table IV.

TABLE IV

| Dispersion | Density @ 420 nm | Lambda-max |
|---|---|---|
| D | 0.85 | 447 nm |
| E | 0.79 | 449 nm |
| F | 0.68 | 456 nm |

These results also indicate that the D23 dye hue is shifted bathochromically and absorption in the short blue region is reduced as the level of R1 is increased.

EXAMPLE 3

A Multilayer Color Negative Film of This Invention Comprising a Yellow Methine Dye of This Invention Codispersed with a Reducing Agent of This Invention The multilayer film structure utilized for this example is shown schematically in Table V. Structures of components not provided previously are given immediately following Table V. Component laydowns are provided in units of g/sq m unless otherwise indicated. Gelatin was used as a binder in the various layers of the multilayer film. These films may be processed using KODAK FLEXICOLOR C-41 processing chemistry. The film was readily manufactured and produced prints of proper color balance.

TABLE V

| MULTILAYER FILM STRUCTURE | |
|---|---|
| Overcoat Layer: | Matte Beads<br>Gelatin (0.89) |
| 2 UV Protective Layer: | UV-1 (0.111) & S-4 (0.111)<br>UV-2 (0.111) & S-4 (0.111)<br>Silver Bromide Lippmann Emulsion (0.215 Ag)<br>Gelatin (0.70) |
| 3 Fast Yellow Layer: | Y-1 (0.150) & S-1 (0.075)<br>IR-1 (0.032) & S-1 (0.016)<br>B-1 (0.0054) & S-3 (0.0070)<br>Blue Sensitive Silver Iodobromide Emulsion (0.430 Ag), 4.5 mole % Iodide T-Grain (2.3 × 0.13 μm)<br>Gelatin (0.753) |
| 4 Slow Yellow Layer: | Y-1 (0.915) & S-1 (0.457)<br>IR-1 (0.032) & S-1 (0.032)<br>B-1 (0.0065) & S-3 (0.0084)<br>Blue Sensitive Silver Iodobromide Emulsion (0.167 Ag), 4.5 mole % Iodide T-Grain (1.4 × 0.13 μm)<br>Blue Sensitive Silver Iodobromide Emulsion (0.091 Ag), 1.5 mole % Iodide T-Grain (0.85 × 0.13 μm)<br>Blue Sensitive Silver Iodobromide Emulsion (0.215 Ag) 1.3 mole % Iodide T-Grain (0.54 × 0.09 μm)<br>Gelatin (1.668)<br>Bis(vinylsulfonyl)methane at 1.8% by weight of total Gelatin |
| 5 Yellow Filter Layer: | R1 (0.075) & S-2 (0.121) & ST-2 (0.010)<br>YD-2 (0.161)<br>Gelatin (0.861) |
| 6 Fast Magenta Layer: | M-1 (0.042) & S-1 (0.038) & ST-1 (0.004) Addendum MM-1 (0.027) & S-1 (0.054)<br>IR-2 (0.016) & S-2 (0.032)<br>Green Sensitive Silver Iodobromide Emulsion (0.699 Ag),<br>4.1 mole % Iodide T-Grain (0.98 × 0.11 μm)<br>Gelatin (1.20) |
| 7 Mid Magenta Layer: | M-1 (0.108) & S-1 (0.097) & ST-1 (0.011)<br>MM-1 (0.032) & S-1 (0.064)<br>IR-2 (0.022) & S-2 (0.044)<br>Green Sensitive Silver Iodobromide Emulsion (0.646 Ag),<br>4.1 mole % Iodide T-Grain (0.56 × 0.12 μm)<br>Gelatin (1.52) |
| 8 Slow Magenta Layer: | M-1 (0.323) & S-1 (0.291) & ST-1 (0.032)<br>MM-1 (0.075) & S-1 (0.150)<br>IR-2 (0.022) & S-2 (0.044) |

TABLE V-continued

| MULTILAYER FILM STRUCTURE | |
|---|---|
| | Green Sensitive Silver Iodobromide Emulsion (0.108 Ag),<br>3.6 mole % Iodide Cubic (0.21 μm)<br>Green Sensitive Silver Iodobromide Emulsion (0.538 Ag),<br>3.7 mole % Iodide Cubic (0.11 μm)<br>Gelatin (1.18) |
| 9 Interlayer: | R1 (0.075) & S-6 (0.113)<br>Gelatin (0.86) |
| 10 Fast Cyan Layer: | CC-1 (0.065) & S-2 (0.065)<br>CM-1 (0.032)<br>IR-3 (0.038) & S-5 (0.076)<br>IR-4 (0.038) & S-2 (0.076)<br>Red Sensitive Silver Iodobromide Emulsion (0.968 Ag),<br>4.5 mole % Iodide T-Grain (1.10 × 0.11 μm)<br>Gelatin (1.45) |
| 11 Mid Cyan Layer: | CC-1 (0.183) & S-2 (0.183)<br>CM-1 (0.011)<br>B-1 (0.027) & S-3 (0.035)<br>IR-3 (0.054) & S-5 (0.108)<br>Red Sensitive Silver Iodobromide Emulsion (0.215 Ag),<br>4.1 mole % Iodide T-Grain (1.06 × 0.11 μm)<br>Red Sensitive Silver Iodobromide Emulsion (0.861 Ag),<br>3.3 mole % Iodide Cubic (0.49 μm)<br>Gelatin (1.35) |
| 12 Slow Cyan Layer: | CC-1 (0.516) & S-2 (0.516)<br>IR-3 (0.043) & S-2 (0.086)<br>B-1 (0.075) & S-3 (0.098)<br>Red Sensitive Silver Iodobromide Emulsion (0.473 Ag),<br>3.3 mole % Iodide Cubic (0.32 μm)<br>Gelatin (1.86) |
| 13 Interlayer: | R1 (0.075) & S-6 (0.113)<br>Gelatin (0.86) |
| 14 Antihalation Layer: | Grey Silver (0.15 Ag), CD-2 (0.0075), MD-1 (0.038)<br>R1 (0.086) & S-6 (0.129)<br>S-1, S-2, Gelatin (1.61)<br>Codispersion of D23 (0.022) & R1 (0.022) & S-1 (0.044) |

| Polyethylene Naphthalate Support with Magnetic Recording Layer | |
|---|---|
| 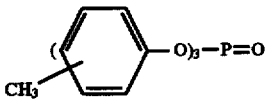 <br>mixed isomers | S-1 |
| 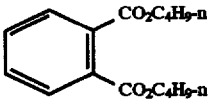 | S-2 |
| 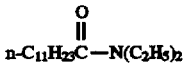 | S-3 |
| 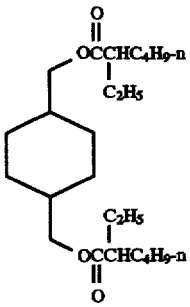 | S-4 |

TABLE V-continued
| MULTILAYER FILM STRUCTURE | |
|---|---|
| 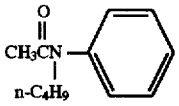 | S-5 |
| 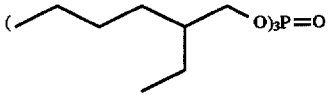 | S-6 |
| 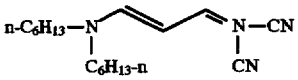 | UV-1 |
| 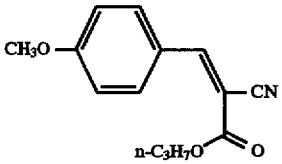 | UV-2 |
| 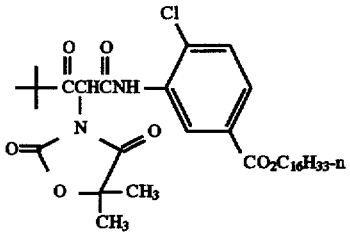 | Y-1 |
| 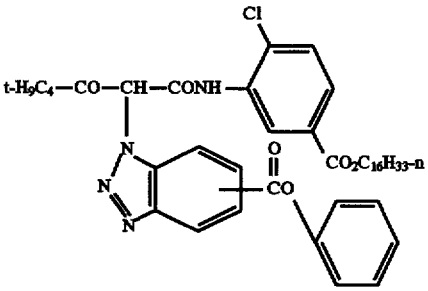 | IR-1 |
| 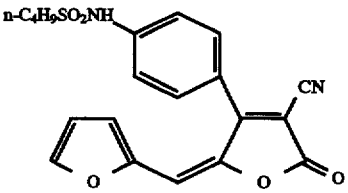 | YD-2 |
| 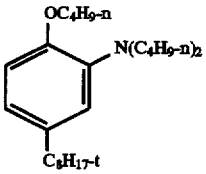 | ST-1 |
| 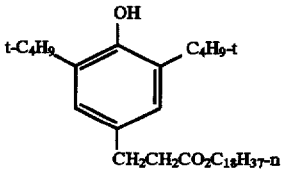 | ST-2 |

TABLE V-continued
| MULTILAYER FILM STRUCTURE | |
|---|---|
| 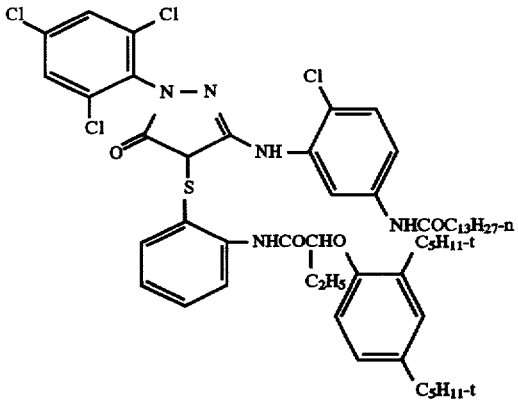 | M-1 |
| 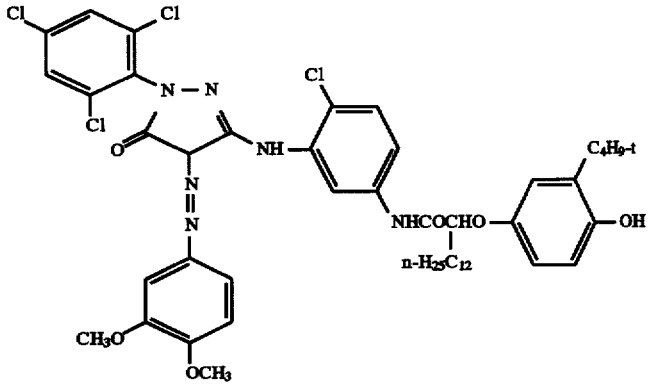 | MM-1 |
| 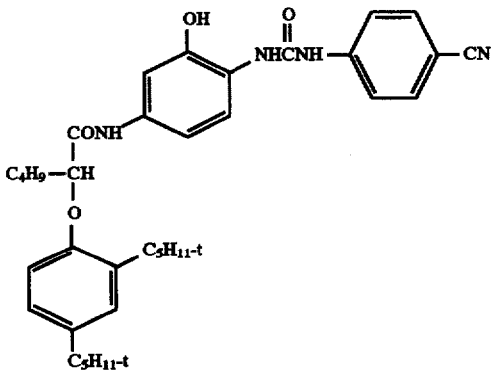 | CC-1 |
| 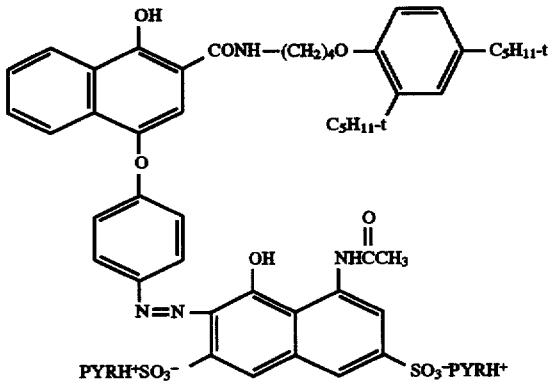 | CM-1 |

TABLE V-continued
| MULTILAYER FILM STRUCTURE | |
|---|---|
| 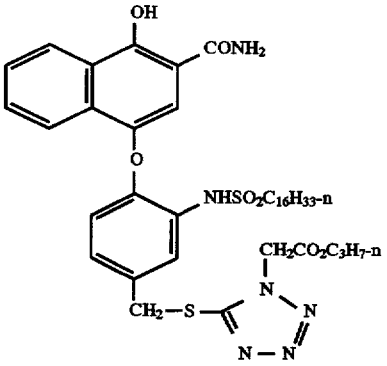 | IR-2 |
| 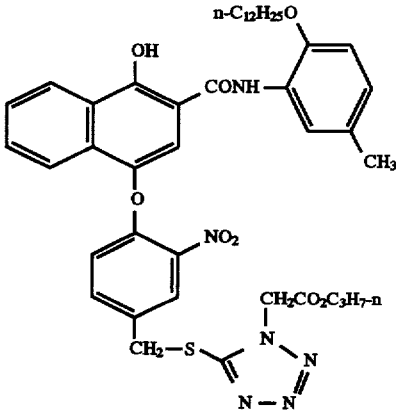 | IR-3 |
| 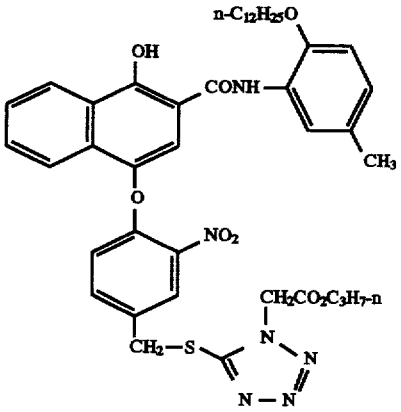 | IR-4 |
| 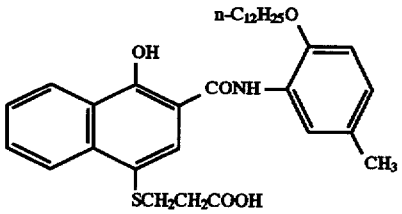 | B-1 |

TABLE V-continued

| MULTILAYER FILM STRUCTURE | |
|---|---|
| 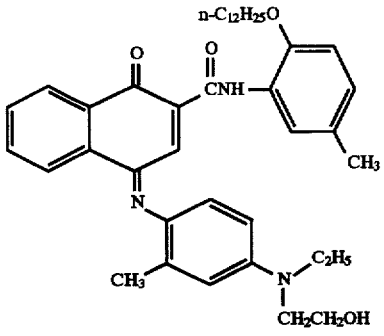 | CD-1 |
| 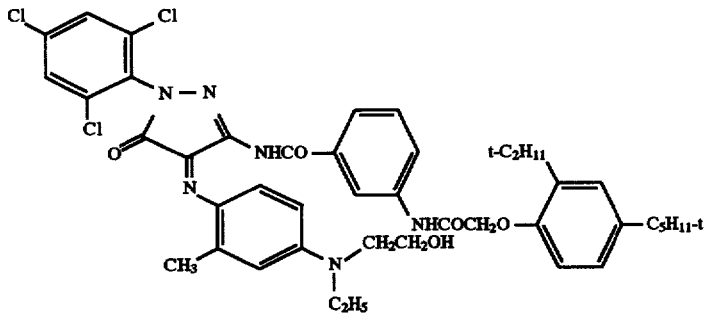 | MD-1 |

The preceding examples are set forth to illustrate specific embodiments of this invention and are not intended to limit the scope of the compositions or materials of the invention. Additional embodiments and advantages within the scope of the claimed invention will be apparent to one skilled in the art.

What is claimed is:

1. A multilayer color negative photographic film element comprising a support, at least one light-sensitive silver halide emulsion layer sensitive to each of the blue, green and red regions of the visible spectrum, one or more yellow or orange-yellow cyano benzoxazolyl or cyano benzothiazolyl arylidene methine filter or density correction dyes of structure I, below, codispersed with one or more hydroquinone, catechol or sulfonamidophenol reducing agents,

I

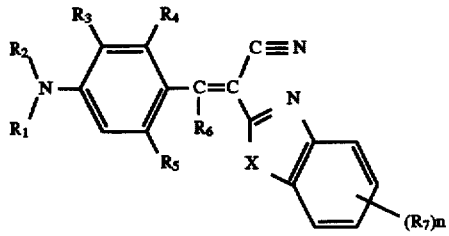

wherein:

$R_1$ is hydrogen or an alkyl group;

$R_2$ is an alkyl group or an aryl group;

$R_3$ is hydrogen, a halogen, an alkyl group, an alkoxy group or an aryloxy group;

$R_4$ is hydrogen or an alkyl group;

$R_5$ is hydrogen or an alkyl group;

$R_6$ is hydrogen or an alkyl group;

X is oxygen or sulfur;

each $R_7$ is independently selected from the group consisting of a halogen, an alkyl, aryl, alkoxy, aryloxy, carbonamido, sulfonamido, carbamoyl, alkoxycarbonyl, aryloxycarbonyl, acyloxy, acyl, sulfamoyl, sulfonyl, sulfoxyl, sulfonyloxy, alkylthio, arylthio, and cyano groups;

n is 0, 1, 2 or 3; and provided that $R_1$ and $R_2$ or $R_2$ and $R_3$ may join to form a ring.

2. A color negative photographic element according to claim 1, wherein the hydroquinone, catechol and sulfonamidophenol reducing agents are of structures II, III and IV, respectively,

II

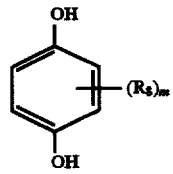

III

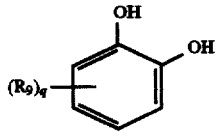

-continued

IV

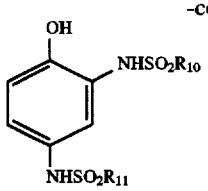

wherein each $R_8$ is an independently selected from the group consisting of an alkyl group, a carbonamido group, a carbamoyl group, an alkoxy group, an aryloxy group and a chlorine atom, and m is 1 to 4;

each $R_9$ is independently selected from the group consisting of an alkyl group, a carbonamido group, a carbamoyl group an alkoxy group, an aryloxy group and a chlorine atom, and q is 1 to 4;

$R_{10}$ is an aryl group or an alkyl group; and $R_{11}$ is an aryl group or an alkyl group.

3. A color negative element according to claim 1, wherein the methine dye has a spectral absorption maximum in the range of 435–480 nm as coated in the element.

4. A color negative element according to claim 1, wherein the methine density correction dye is coated at a level of from 0.005 to 0.150 g/sq m.

5. A color negative element according to claim 4, wherein the methine density correction dye is coated at a level of from 0.010 to 0.10 g/sq m.

6. A color negative element according to claim 1, wherein the total number of carbon atoms in $R_1$ through $R_7$ is at least 8.

7. A color negative element according to claim 1, wherein the total number of carbon atoms in $R_1$ through $R_7$ is at least 10.

8. A color negative element according to claim 1, wherein the methine dye is free of charged groups, carboxyl groups and sulfonate groups.

9. A color negative element according to claim 2, wherein the total number of carbon atoms in the $R_8$ groups where formula II applies, the $R_9$ groups where formula III applies, or the combined $R_{10}$ and $R_{11}$ groups where formula IV applies, of the reducing agents of this invention is at least 12.

10. A color negative element according to claim 9, wherein the total number of carbon atoms in the $R_8$ groups where formula II applies, the $R_9$ groups where formula III applies, or the combined $R_{10}$ and $R_{11}$ groups where formula IV applies, of the reducing agents of this invention is at least 16.

11. A color negative element according to claim 1, wherein the weight ratio of yellow methine dye to reducing agent in the codispersion is from 1:0.2 to 1:5.

12. A color negative element according to claim 11, wherein the weight ratio of yellow methine dye to reducing agent is from 1:0.5 to 1:2.

13. A color negative element according to claim 1, wherein the methine dye is dispersed together with a high-boiling solvent at a dye:solvent weight ratio of from 0.1 to 10.0.

14. A color negative element according to claim 1, wherein the methine dye is coated as a dispersion prepared without the use of a removable auxiliary solvent.

15. A color negative element according to claim 1, wherein $R_4$ is hydrogen.

16. A color negative element according to claim 1, wherein X is oxygen.

17. A color negative element according to claim 1, wherein $R_5$ is an alkyl group.

18. A color negative element according to claim 1, wherein $R_6$ is hydrogen.

19. A color negative element according to claim 1, wherein $R_2$ is an alkyl group.

20. A color negative element according to claim 1, wherein $R_1$ is hydrogen, $R_2$ is alkyl, $R_3$ is hydrogen or alkyl, $R_4$ is hydrogen, $R_5$ is alkyl, $R_6$ is hydrogen, X is oxygen, n is 0 or 1 and, when n is 1, $R_7$ is an alkyl group, a sulfonamido group or a halogen in the para position relative to X.

21. A color negative element according to claim 1, wherein $R_1$ and $R_2$ are alkyl groups, $R_3$, $R_4$ and $R_6$ are hydrogen, $R_5$ is an alkyl group, X is oxygen, n is 0 or 1 and, when n is 1, $R_7$ an alkyl group, a sulfonamido group or a halogen in the para position relative to X.

22. A color negative element according to claim 1, wherein the methine dye is selected from the following:

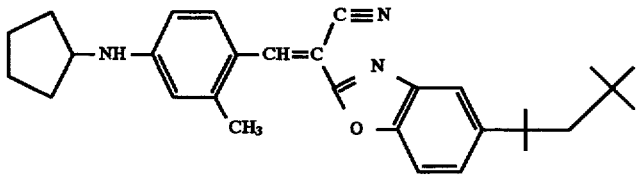

D1

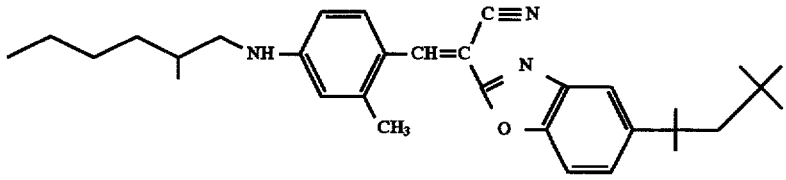

D2

-continued
D3
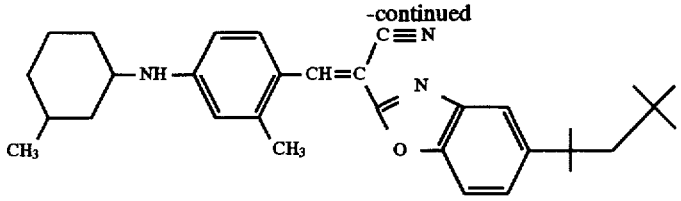
D6
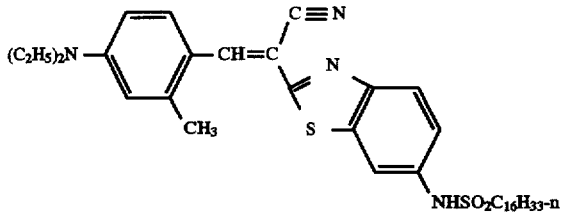
D8
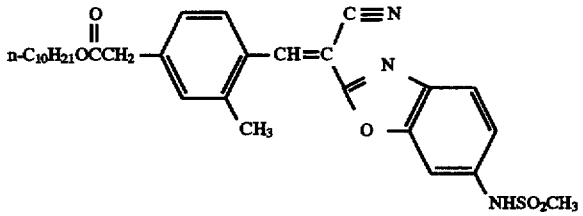
D9
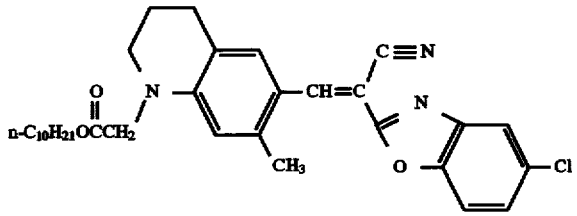
D21
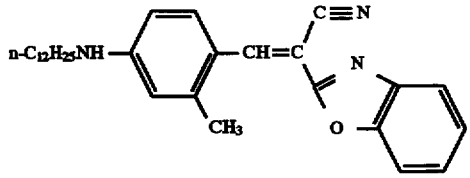
D22
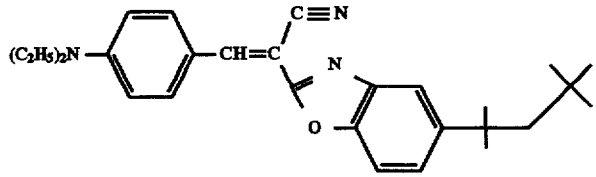
D23
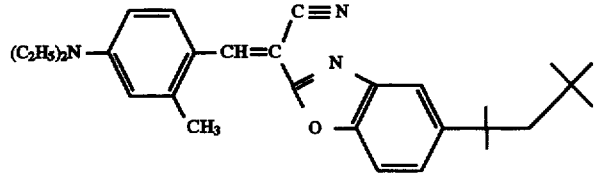
D25
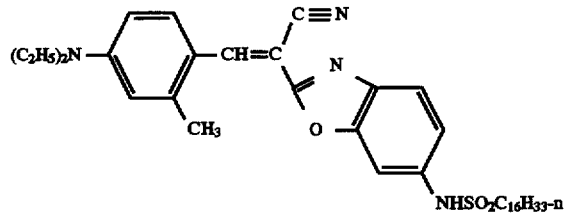

-continued

D26

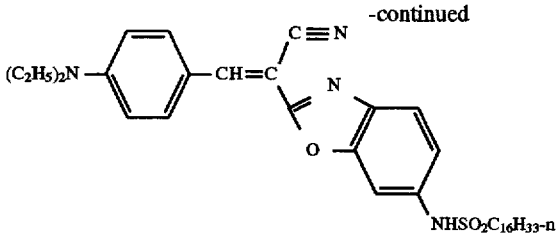

D29

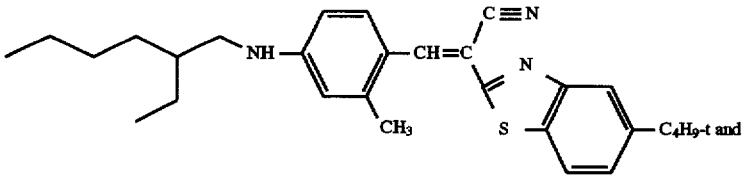

D35

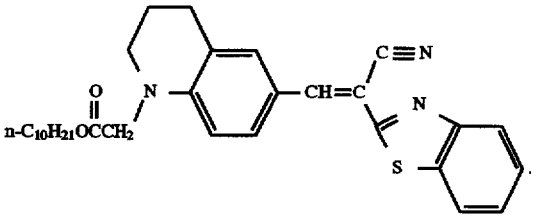

23. A color negative element according to claim 1, wherein the methine dye is coated in the antihalation layer.

24. A color negative element according to claim 1, wherein the methine dye is coated in a filtration layer between blue and green-sensitive layers.

25. A color negative element according to claim 2 wherein the reducing agent is selected from the following:

R1

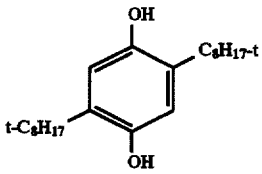

R2

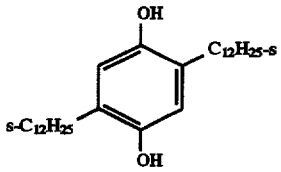

R3

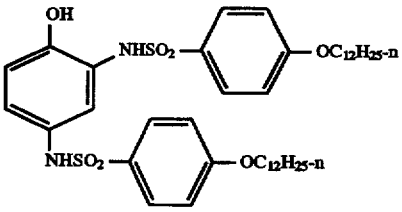

R4

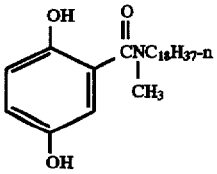

-continued

R5

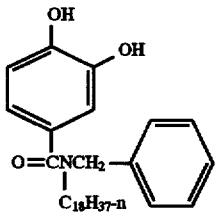

R6

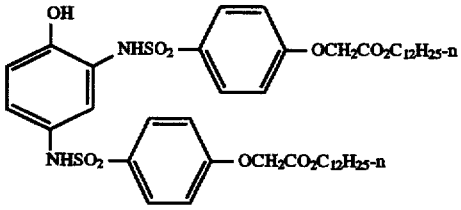

R9

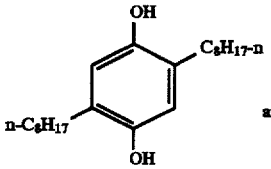

and

R11

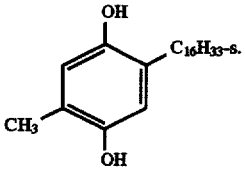

26. A codispersion of one or more yellow methine dyes of structure I with one or more reducing agents of structure II, III or IV in the same oil phase;

I

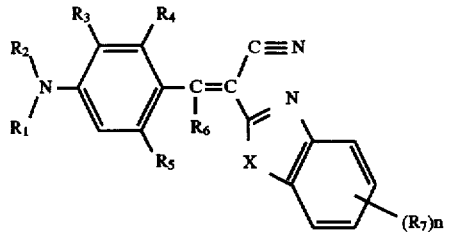

wherein:

$R_1$ is hydrogen or an alkyl group;

$R_2$ is an alkyl group or an aryl group;

$R_3$ is hydrogen, a halogen atom (such as chlorine or fluorine), an alkyl group, an alkoxy group or an aryloxy group;

$R_4$ is hydrogen or an alkyl group;

$R_5$ is hydrogen or an alkyl group;

$R_6$ is hydrogen or an alkyl group;

X is oxygen or sulfur;

$R_7$ is a substituent selected from the group consisting of halogen atoms (such as chlorine or fluorine), alkyl, aryl, alkoxy, aryloxy, carbonamido, sulfonamido, carbamoyl, alkoxycarbonyl, aryloxycarbonyl, acyloxy, acyl, sulfamoyl, sulfonyl, sulfoxyl, sulfonyloxy, alkylthio, arylthio, and cyano groups;

n is 0, 1, 2 or 3; and $R_1$ and $R_2$ or $R_2$ and $R_3$ may join to form a ring;

II

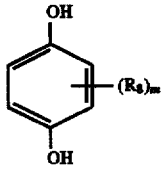

-continued

III

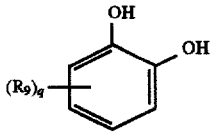

IV

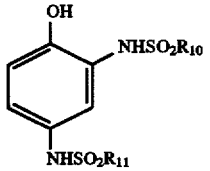

wherein:

each $R_8$ is an independently selected from the group consisting of an alkyl group, a carbonamido group, a carbamoyl group, an alkoxy group, an aryloxy group and a chlorine atom and m is 1 to 4;

each $R_9$ is independently selected from the group consisting of an alkyl group, a carbonamido group, a carbamoyl group an alkoxy group, an aryloxy group and a chlorine atom and q is 1 to 4;

$R_{10}$ is an aryl group or an alkyl group; and $R_{11}$ is an aryl group or an alkyl group.

* * * * *